US010988334B2

(12) United States Patent
Uchida

(10) Patent No.: US 10,988,334 B2
(45) Date of Patent: Apr. 27, 2021

(54) SHEET CONVEYANCE APPARATUS AND IMAGE FORMING APPARATUS

(71) Applicant: CANON KABUSHIKI KAISHA, Tokyo (JP)

(72) Inventor: Yuki Uchida, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 108 days.

(21) Appl. No.: 16/542,444

(22) Filed: Aug. 16, 2019

(65) Prior Publication Data

US 2020/0073317 A1 Mar. 5, 2020

(30) Foreign Application Priority Data

Sep. 5, 2018 (JP) ..... JP2018-166089

(51) Int. Cl.

| | |
|---|---|
| ***B65H 5/38*** | (2006.01) |
| ***G03G 21/16*** | (2006.01) |
| ***G03G 15/00*** | (2006.01) |
| ***B65H 29/52*** | (2006.01) |
| ***B65H 5/36*** | (2006.01) |

(52) U.S. Cl.

CPC ..... *B65H 5/38* (2013.01); *B65H 5/36* (2013.01); *B65H 29/52* (2013.01); *G03G 15/70* (2013.01); *G03G 21/1638* (2013.01); *B65H 2402/441* (2013.01); *B65H 2402/45* (2013.01); *B65H 2404/74* (2013.01); *B65H 2407/21* (2013.01);

(Continued)

(58) Field of Classification Search

CPC ... B65H 3/66; B65H 3/68; B65H 5/36; B65H 5/38; B65H 7/02; B65H 7/04; B65H 7/06; B65H 7/14; B65H 2402/441; B65H 2402/45; B65H 2404/50; B65H 2404/61; B65H 2404/63; B65H 2404/74; B65H 2405/115; B65H 2407/21; B65H 2407/32; B65H 2511/528; B65H 2553/41; B65H 2553/612; B65H 2601/11; B65H 2601/255; G03G 15/6514; G03G 15/70; G03G 21/1638

See application file for complete search history.

(56) References Cited

U.S. PATENT DOCUMENTS

2010/0098473 A1* 4/2010 Hosoi ..... G03G 21/1642 399/400
2020/0218182 A1* 7/2020 Sugiyama ..... G03G 15/2028

FOREIGN PATENT DOCUMENTS

JP 2005-031377 A 2/2005
JP 2007-070044 A 3/2007

* cited by examiner

*Primary Examiner* — Prasad V Gokhale
(74) *Attorney, Agent, or Firm* — Venable LLP

(57) ABSTRACT

A sheet conveyance apparatus includes a first guide provided in an apparatus body, a second guide provided in an openable portion, a flag member supported by the apparatus body pivotally, a detection unit configured to detect pivoting of the flag member, and a jam release guide provided in the apparatus body. In a state where the openable portion is open, the flag member is protruded into a space that is created between the openable portion and the apparatus body by an opening operation of the openable portion. The jam release guide is disposed at a position not hampering conveyance of the sheet in a state where the openable portion is closed, and is disposed to come in contact, together with the flag member, with a jammed sheet to regulate a posture of the jammed sheet in a state where the openable portion is open.

19 Claims, 11 Drawing Sheets

(52) U.S. Cl.
CPC ..... *B65H 2553/41* (2013.01); *B65H 2601/11* (2013.01); *G03G 2221/1687* (2013.01)

SHEET CONVEYANCE APPARATUS AND IMAGE FORMING APPARATUS

BACKGROUND OF THE INVENTION

Field of the Invention

The present invention relates to a sheet conveyance apparatus conveying a sheet and to an image forming apparatus forming an image on the sheet.

Description of the Related Art

An image forming apparatus such as a printer, a copier or a multifunction printer is provided with an openable portion, serving as a cover or a door openable with respect to an apparatus body, which is widely adopted as a configuration that enables to remove a sheet jammed, i.e., a jammed sheet, in a sheet conveyance path within the apparatus by opening the openable portion. Japanese Patent Application Laid-open No. 2007-070044 for example discloses an image forming apparatus in which a manual sheet feeding apparatus, including a manual feed tray and a sheet feed roller, is fixed to a side cover provided on a side surface of an apparatus body and a conveyance path of a sheet fed from the manual sheet feeding apparatus is exposed by opening the side cover.

As for the image forming apparatus, it is also known to detect a sheet on a conveyance path, not limiting to the sheet fed from the manual sheet feeding apparatus, by sensors provided on the sheet conveyance path to control a conveyance operation based on a detection result. As the sensor of such sort, a system including a flag member protruding into the sheet conveyance path and detecting pivoting of the flag member by a photoelectric sensor is often used.

However, if the flag member supported by the apparatus body is disposed in a part of the sheet conveyance path or in a vicinity thereof which is exposed when the openable portion is open, there is a case where a jammed sheet is caught by the flag member and is torn in removing the jammed sheet. If the torn piece of the sheet remains within the apparatus, it leads to a conveyance failure such as sheet jamming or to generation of abnormal sound.

SUMMARY OF THE INVENTION

The present disclosure provides a sheet conveyance apparatus that is capable of reducing a possibility of a sheet from being torn and an image forming apparatus including the same.

According to one aspect of the invention, a sheet conveyance apparatus includes: a first guide provided in an apparatus body: a second guide provided in an openable portion configured to be opened and closed with respect the apparatus body, the second guide being arranged to define a sheet conveyance path between the first guide and the second guide in a state where the openable portion is closed and to separate from the first guide along with an opening operation of the openable portion; a flag member supported by the apparatus body pivotally on a pivot provided on a same side with the second guide with respect to the sheet conveyance path and configured to pivot when pressed by a sheet passing through the sheet conveyance path; a detection unit configured to detect pivoting of the flag member; and a jam release guide provided in the apparatus body, wherein in a state where the openable portion is open, the flag member is protruded into a space that is created between the openable portion and the apparatus body by the opening operation of the openable portion, and wherein the jam release guide is disposed at a position not hampering conveyance of the sheet in passing through the sheet conveyance path in a state where the openable portion is closed, and is disposed to come in contact, together with the flag member, with a jammed sheet jammed in the sheet conveyance path to regulate a posture of the jammed sheet in a state where the openable portion is open.

According to another aspect of the invention, an image forming apparatus includes: a sheet conveyance apparatus conveying a sheet; an image forming unit forming an image on the sheet conveyed by the sheet conveyance apparatus, wherein the sheet conveyance apparatus includes: a first guide provided in an apparatus body: a second guide provided in an openable portion configured to be opened and closed with respect the apparatus body, the second guide being arranged to define a sheet conveyance path between the first guide and the second guide in a state where the openable portion is closed and to separate from the first guide along with an opening operation of the openable portion; a flag member supported by the apparatus body pivotally on a pivot provided on a same side with the second guide with respect to the sheet conveyance path and configured to pivot when pressed by a sheet passing through the sheet conveyance path; a detection unit configured to detect pivoting of the flag member; and a jam release guide provided in the apparatus body, wherein in a state where the openable portion is open, the flag member is protruded into a space that is created between the openable portion and the apparatus body by the opening operation of the openable portion, and wherein the jam release guide is disposed at a position not hampering conveyance of the sheet in passing through the sheet conveyance path in a state where the openable portion is closed, and is disposed to come in contact, together with the flag member, with a jammed sheet jammed in the sheet conveyance path to regulate a posture of the jammed sheet in a state where the openable portion is open.

According to still another aspect of the invention, a sheet conveyance apparatus includes: a first guide provided in an apparatus body: a second guide provided in an openable portion configured to be opened and closed with respect the apparatus body, the second guide being arranged to define a sheet conveyance path between the first guide and the second guide in a state where the openable portion is closed and to separate from the first guide along with an opening operation of the openable portion; an upstream guide provided in the apparatus body, the upstream guide being disposed adjacent to and upstream of the second guide in a sheet conveyance direction in the sheet conveyance path such that the upstream guide and the second guide face a same surface of the sheet passing through the second guide in a state where the openable portion is closed; a flag member supported by the apparatus body pivotally on a pivot provided on a same side with the second guide with respect to the sheet conveyance path and configured to pivot when pressed by a sheet passing through the sheet conveyance path; a detection unit configured to detect pivoting of the flag member; and a jam release guide provided in the apparatus body, wherein a first point is defined as a position of the downstream end in the sheet conveyance direction of the upstream guide when seen in a width direction orthogonal to the sheet conveyance direction, and a second point is defined as a position of the tip of the flag member pivoted to a limit position within a pivotable range of the flag member toward a downstream side in the sheet conveyance direction when seen in the width direction, wherein the second point is located downstream of the first point in a moving direction of the sheet in passing through a position corresponding to the first point of the sheet conveyance path, and the flag member is disposed such that the second point is protruded into the space that is created between the openable portion and the apparatus body by the opening operation of the openable portion, and wherein the jam release guide is disposed to be on a same side with the second guide and the upstream guide with respect to the sheet conveyance path and not to be protruded into the sheet conveyance path when seen in the width direction in a state where the openable portion is closed, and is disposed to be protruded toward the first guide crossing over a line connecting the first point and the second point when seen in the width direction in a state where the openable portion is open.

Further features of the present invention will become apparent from the following description of exemplary embodiments with reference to the attached drawings.

DESCRIPTION OF THE EMBODIMENTS

An exemplary embodiment of the invention will be described with reference to the drawings.

Figure 1:
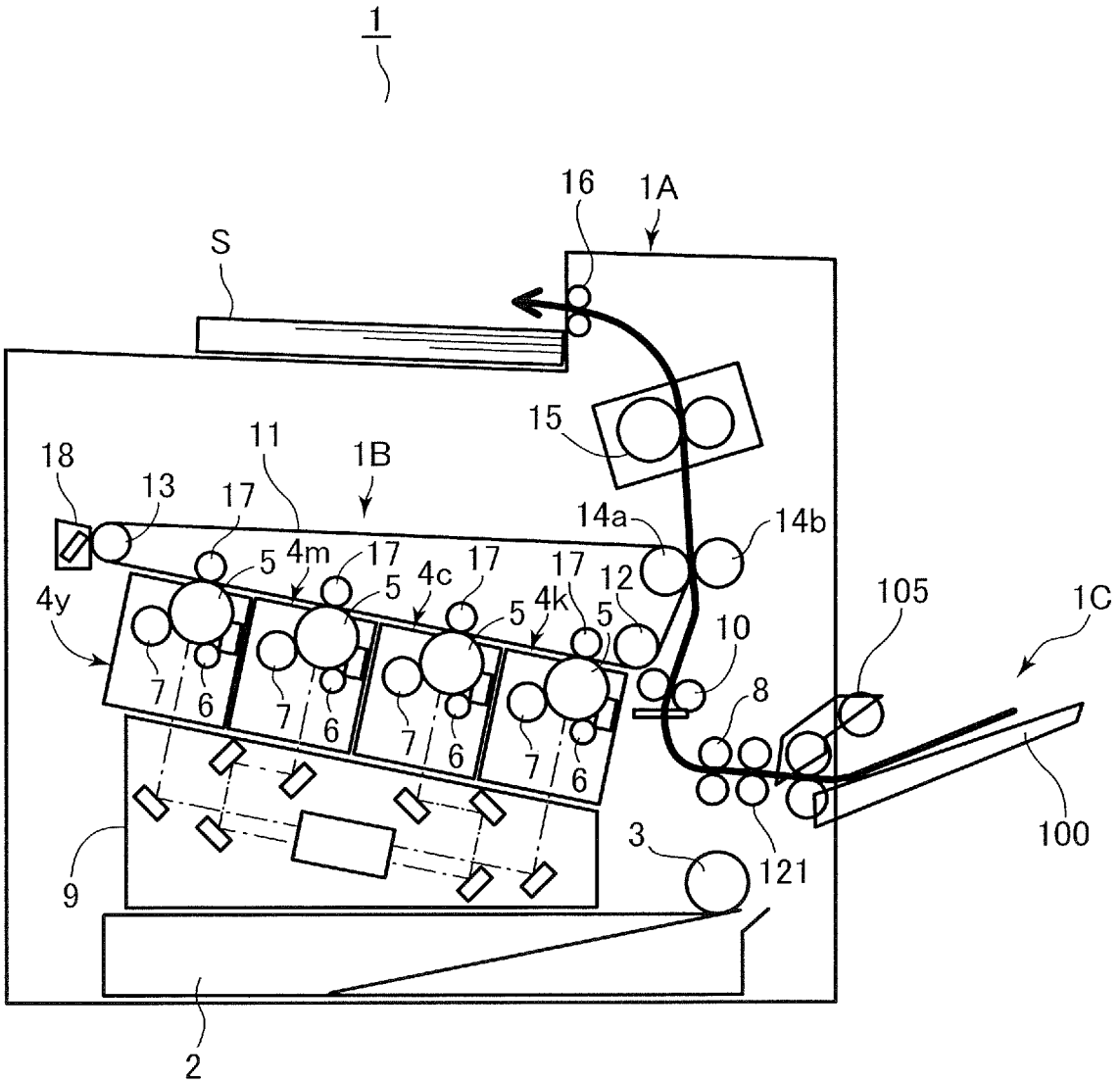
FIG. 1 is a schematic diagram illustrating a configuration of an image forming apparatus according to an embodiment of the present disclosure.

FIG. 1 is a schematic diagram illustrating a configuration of an image forming apparatus 1 of the present embodiment. The image forming apparatus 1 is a color laser printer forming an image on a sheet S used as a recording material based on image information inputted from a computer serving as an external terminal. The recording material to be used includes, besides a sheet of paper such as a plain paper and a thick sheet, a plastic film for an overhead projector, a sheet material in a specific shape such as an envelope and an index sheet and a sheet material such as cloth.

An intermediate transfer and tandem type image forming unit 1B including four imaging units 4*y*, 4*m*, 4*c* and 4*k* and an intermediate transfer belt 11 is mounted in an apparatus body 1A of the image forming apparatus 1. Each of the imaging units 4*y* through 4*k* includes a photosensitive drum 5, a charging roller 6 and a developing roller 7, is configured as a cartridge attachable to the apparatus body 1A, and forms a toner image of yellow, magenta, cyan or black through an electro-photographic process. That is, as the photosensitive drum 5 serving as a photoconductor rotates, the charging roller 6 homogeneously charges a surface of the photosensitive drum 5. A laser scanner 9 disposed under the imaging units 4*y* through 4*k* writes an electrostatic latent image on the surface of the photosensitive drum 5 by irradiating the photosensitive drum 5 with a laser beam modulated corresponding to the image information. The developing roller 7 develops the electrostatic latent image as a toner image by supplying electrified toner to the photosensitive drum 5.

The intermediate transfer belt 11 is wrapped around a driving roller 12, a tension roller 13 and a secondary transfer counter roller 14*a*. Toner images borne on the photosensitive drums 5 of the imaging units 4*y* through 4*k* are primarily transferred onto the intermediate transfer belt 11 by primary transfer rollers 17. In that process, because the four color toner images are transferred to be superimposed on one another, a full-color toner image is formed on the intermediate transfer belt 11. Adhesive materials such as the toner left on the photosensitive drum 5 without being transferred onto the intermediate transfer belt 11 are removed by a drum cleaner provided in each of the imaging units 4Y through 4*k*. As the intermediate transfer belt 11 rotates, the toner image borne on the intermediate transfer belt 11 is conveyed toward a secondary transfer portion defined between the secondary transfer counter roller 14*a* and a secondary transfer roller 14*b* facing the secondary transfer counter roller 14*a*.

In parallel to such toner image forming process, the sheet S is fed from a feed cassette 2 or a manual sheet feed portion 1C. The feed cassette 2 is a sheet storage portion drawable out of the apparatus body 1A. The sheet S stacked in the feed cassette 2 is fed one by one by a feed roller 3 toward a conveyance roller 8. The sheet S set on a manual feed tray 100 is fed one by one by the manual sheet feed portion 1C also toward the conveyance roller 8. A configuration of the manual sheet feed portion 1C will be described later in detail.

The conveyance roller 8 conveys the sheet S toward a registration roller 10. The sheet S abuts with the registration roller 10 in a stopped state to correct a skew thereof and is fed to the secondary transfer portion synchronously with the progress of the toner image forming process of the image forming unit 1B. The toner image borne on the intermediate transfer belt 11 is secondarily transferred onto the sheet S in the secondary transfer portion. Adhesive materials such as the toner left on the intermediate transfer belt 11 without being transferred onto the sheet S is removed by a belt cleaner 18.

The sheet S that has passed the secondary transfer portion and includes the non-fixed toner image formed thereon is conveyed to a fixing unit 15. The fixing unit 15 includes a roller pair nipping and conveying the sheet S and a heat source such as a halogen lump that heats the toner image on the sheet S to fix the toner image onto the sheet S by using heat and pressure. The sheet S delivered from the fixing unit 15 is discharged by a sheet discharge roller 16 to a discharge tray provided at an upper part of the apparatus body 1A.

The image forming unit 1B described above is one example of an image forming unit. That is, instead of the image forming unit 1B, a direct transfer type electro-photographic unit that directly transfers a toner image formed on the photosensitive drum onto the sheet S or an ink-jet type or an offset printing type image forming unit may be mounted in the apparatus body 1A as the image forming unit.

Manual Sheet Feed Portion

Figure 2A:
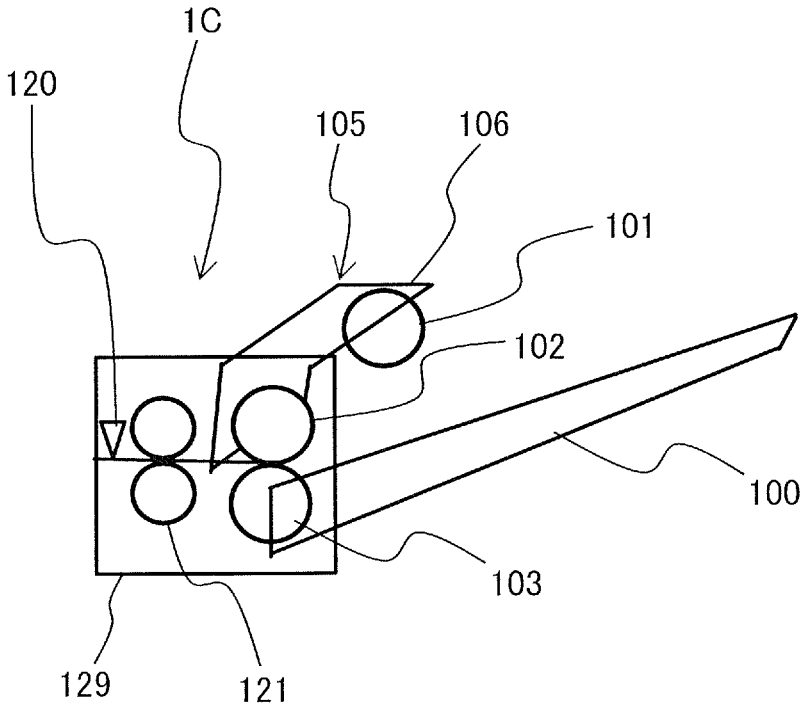
FIG. 2A is a schematic diagram illustrating a manual sheet feed portion of the present embodiment.
Figure 2B:
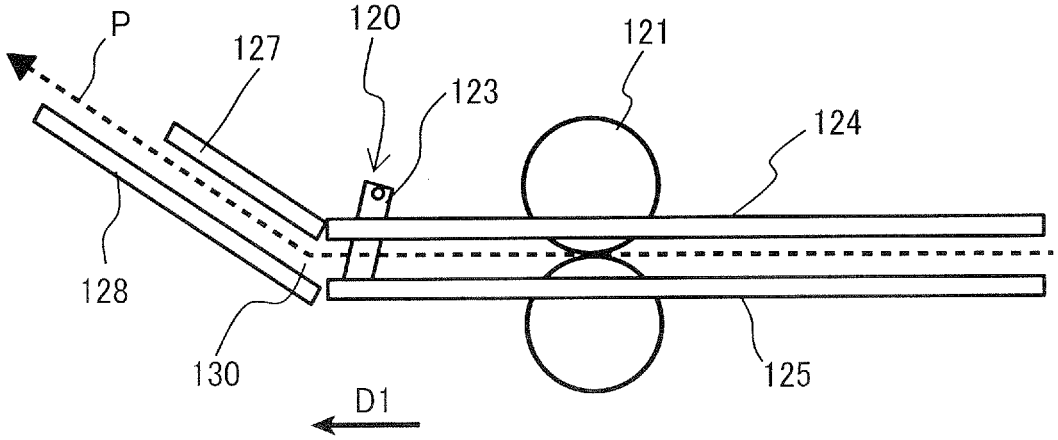
FIG. 2B is a schematic diagram illustrating a feed sensor and a periphery thereof.
Figure 3A:
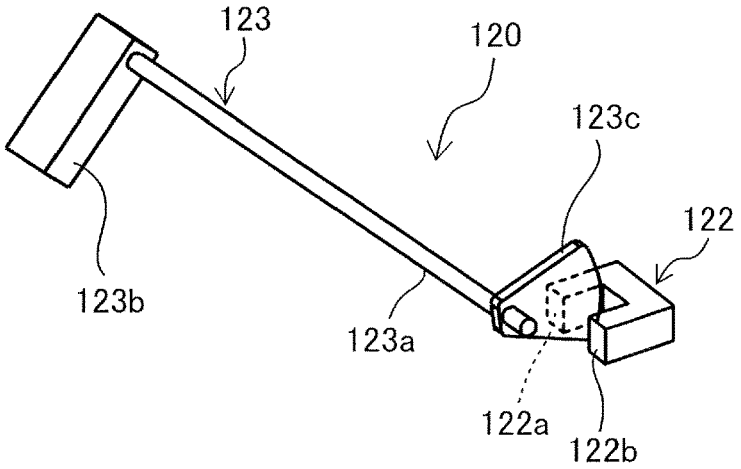
FIG. 3A is a perspective view illustrating a sensor flag of the feed sensor of the present embodiment.
Figure 3B:
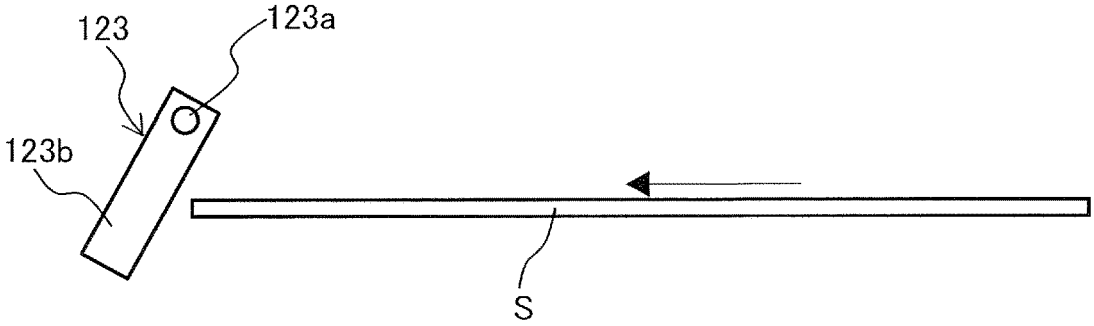
FIG. 3B is a schematic diagram illustrating an operation of the sensor flag.
Figure 3C:
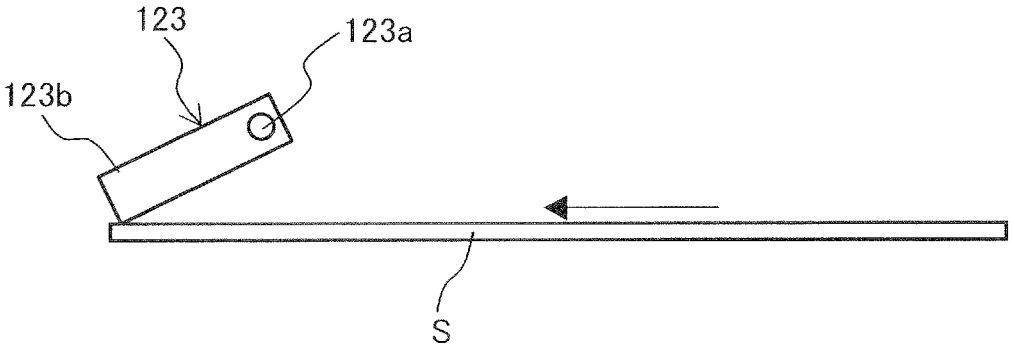
FIG. 3C is a schematic diagram illustrating the operation of the sensor flag.
Figure 4:
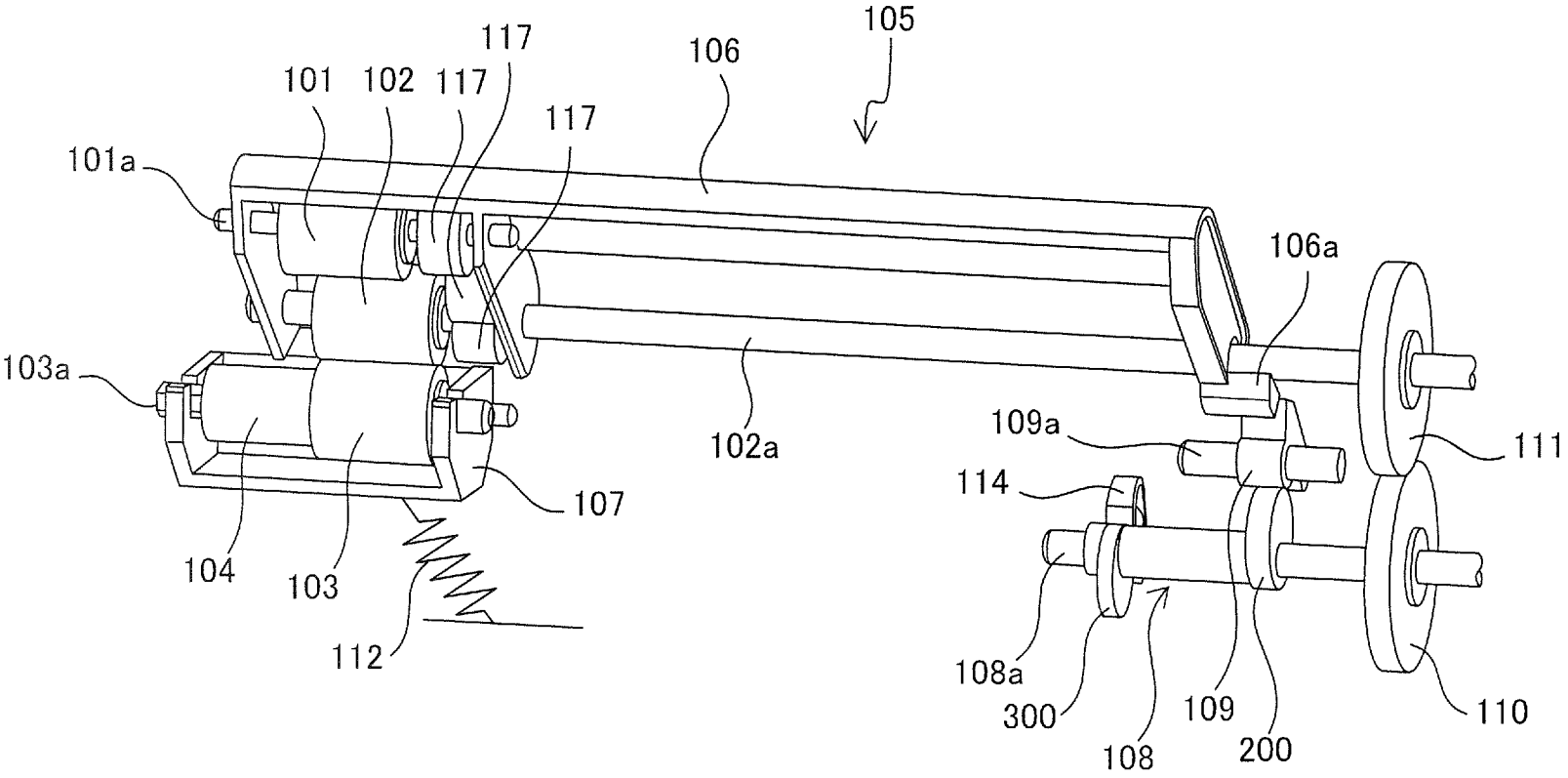
FIG. 4 is a perspective view illustrating a sheet feeding unit of the present embodiment.

Next, a configuration and an operation of the manual sheet feed portion 1C will be described with reference to FIGS. 2 through 4. FIG. 2A is a schematic diagram illustrating the manual sheet feed portion 1C of the present embodiment, and FIG. 2B is a schematic diagram illustrating a feed sensor 120 and a periphery thereof. FIG. 3A is a perspective view illustrating a sensor flag 123 of the feed sensor 120, and FIGS. 3B and 3C are schematic diagrams illustrating an operation of the sensor flag 123. FIG. 4 is a perspective view illustrating a sheet feeding unit 105 of the manual sheet feed portion 1C.

As illustrated in FIG. 2A, the manual sheet feed portion 1C includes a manual feed tray 100, the feed unit 105 and a conveyance roller 121. The manual feed tray 100 serves as a sheet supporting portion of the present embodiment, the feed unit 105 serves as a sheet feeding unit of the present embodiment, and the conveyance roller 121 serves as a sheet conveying unit of the present embodiment.

The feed unit 105 includes a pickup roller 101, a feed roller 102 and a separation roller 103 and feeds a sheet set on the manual feed tray 100 one by one. The conveyance roller 121 is a roller pair rotating while nipping the sheet and receives the sheet from the feed unit 105 to convey it toward the conveyance roller 8.

As illustrated in FIG. 2B, the sheet delivered from the conveyance roller 121 is conveyed through a sheet conveyance path 130 defined by an upper conveyance guide 124, a lower conveyance guide 125, an upper pre-registration guide 127 and a lower pre-registration guide 128. Among them, the upper conveyance guide 124 and the upper pre-registration guide 127 face an upper surface of the sheet in FIG. 2B, and the lower conveyance guide 125 and the lower pre-registration guide 128 face a lower surface of the sheet in FIG. 2B. The upper conveyance guide 124 and the lower conveyance guide 125 are adjacent with each other upstream in a sheet conveyance direction with respect to the upper pre-registration guide 127 and the lower pre-registration guide 128.

The lower pre-registration guide 128 serves as a first guide in the present embodiment and the upper pre-registration guide 127 serves as a second guide in the present embodiment. The upper conveyance guide 124 serves also as an upstream guide of the present embodiment which is adjacent to and upstream of the second guide. However, "adjacent in the sheet conveyance direction" is not limited to a case where the guides are adjacent with each other at their boundary positions and includes a case where they face with each other in the sheet conveyance direction over a gap.

As illustrated in FIG. 4, the feed roller 102 is attached to a feed roller shaft 102*a*. The feed roller shaft 102*a* is provided with a feed gear 111, and a driving force from a driving source such as a motor is transmitted to the feed roller 102 through the feed gear 111 and the feed roller shaft 102*a*. The feed roller shaft 102*a* is also connected with a roller shaft 101*a* of the pickup roller 101 through a plurality of gears 117, and the pickup roller 101 rotates together with the feed roller 102.

The separation roller 103 is connected with a separation roller shaft 103*a* non-rotatably supported by a roller holder 107 through a torque limiter 104. The torque limiter 104 regulates rotation of the separation roller 103 and permits the separation roller 103 to rotate in a case where a load torque exceeding a threshold value acts on the separation roller 103. A pressure spring 112 is provided between the roller holder 107 and a frame of the manual sheet feed portion 1C. The pressure spring 112 urges the roller holder 107 upward in FIG. 4 such that the separation roller 103 comes into pressure contact with the feed roller 102.

An elevating plate 106 configured to support the pickup roller 101 swings up and down around the feed roller shaft 102*a*. Along with the swing of the elevating plate 106, the pickup roller 101 moves between a feed position where the pickup roller 101 is in contact with the sheet S set on the manual feed tray 100 and a separate position where the pickup roller 101 is separated upward from the feed position. An elevating operation of the elevating plate 106 is controlled by a cam mechanism including a multi-cam 108. The multi-cam 108 includes a first cam 200 and a second cam 300 provided on a common cam shaft 108*a* and rotates by the driving force transmitted from the feed gear 111 through a cam gear 110.

As the multi-cam 108 turns, a cam follower 109 in contact with a cam surface of the first cam 200 swings centering on a cam follower shaft 109*a*. The elevating plate 106 is urged downward by a spring member not illustrated. When the cam follower 109 swings in a direction of separating from an engagement portion 106*a* of the elevating plate 106, the elevating plate 106 drops and the pickup roller 101 moves from the separate position to the feed position. When the first cam 200 turns once, the cam follower 109 engages again with the engagement portion 106*a*, the elevating plate 106 is elevated while resisting against an urging force of the spring member and the pickup roller 101 returns to the separate position. Note that the second cam 300 suppresses a drop speed of the elevating plate 106 by receiving a resistant force by engaging with a brake lever 114 urged by the spring member and has an effect of reducing a sound of collision of the pickup roller 101 hitting against the sheet.

In a case where the manual sheet feed portion 1C performs a feed operation, the feed gear 111 is rotationally driven such that the multi-cam 108 is rotated once. Then, the pickup roller 101 and the feed roller 102 rotate and the elevating plate 106 drops such that the pickup roller 101 moves to the feed position. When the pickup roller 101 comes into contact with the sheet S, an uppermost sheet is delivered toward the feed roller 102.

In a case where only the uppermost sheet enters a nip portion, i.e., a separation nip, between the feed roller 102 and the separation roller 103, the torque limiter 104 slips by a force which is received by the separation roller 103 from the feed roller 102 through the sheet and rotates along the sheet conveyance direction. In a case where a plurality of sheets enters the separation nip, a load of the torque limiter 104 surpasses a frictional force between the sheets, so that the separation roller 103 stops and only the uppermost sheet is conveyed while being slid over another sheet. The drive of the feed unit 105 continues at least until when a leading edge of the sheet arrives at a nip portion of a conveyance roller 121. Then, the sheet is conveyed further by the conveyance roller 121 toward the downward conveyance roller 8.

Note that the feed unit 105 is just one example of the sheet feeding unit to feed the sheet one by one. For instance, a sheet feeding unit in which the pickup roller 101 is omitted and the feed roller 102 directly comes into contact with a sheet on a sheet supporting portion may be used instead of the feed unit 105 of the present embodiment. Still further, a frictional pad may be disposed instead of the separation roller 103 as a mechanism for separating the sheet.

Feed Sensor

As illustrated in FIGS. 2A and 2B, the manual sheet feed portion 1C is provided with a feed sensor 120 for detecting passage of the sheet S. In the present embodiment, the feed sensor 120 detects the sheet at a detection position downstream of the conveyance roller 121 and upstream of the conveyance roller 8 (see FIG. 1). A detection result of the feed sensor 120 includes information on whether the sheet has actually arrived at the detection position of the feed sensor 120 after when the manual sheet feed portion 1C had started the feed operation and information on arrival time. In the present embodiment, a conveyance speed of the sheet is controlled in response to the detection result of the feed sensor 120. A reason why the control of the conveyance speed is made and a preferable position of the detection position can explained as follows.

Because the pickup roller 101 has no counter roller, the pickup roller 101 often conveys the sheet while permitting slippage of a certain degree with respect to the sheet. Because the feed roller 102 receives a load of the separation roller 103, a rotational speed thereof drops as compared to a case where there is no load. The degree of slippage and a degree of the load subjected to the feed roller 102 vary depending on conditions such as a material (e.g., a grammage and/or surface treatment of the sheet) and a number of sheets entering the separation nip. Due to such reasons, an actual conveyance speed of the sheet before arriving at the conveyance roller 121 is unstable. Meanwhile, once the sheet has arrived at the nip portion, the conveyance speed varies less because the conveyance roller 121, which does not meet the abovementioned reasons, nips and conveys the sheet.

By the way, in order to achieve high productivity of the image forming apparatus 1, i.e., a number of image forming sheets per unit time, it is required to supply the sheets toward the image forming unit 1B at certain intervals. Due to that, a conveyance speed for conveying a sheet from when the sheet arrives at a predetermined position on a conveyance path until when the sheet arrives at a target position such as the registration roller 10 is often found to adjust a rotational speed of a related conveyance roller. Because the conveyance speed of the sheet is not stable in a state before the sheet arrives at the nip portion of the conveyance roller 121 as described above, it is difficult to accurately estimate when the sheet arrives at the target position if the sheet is detected upstream of the conveyance roller 121. Meanwhile, it is possible to accurately estimate when the sheet arrives at the target position from the time detected by the feed sensor 120 by configuring such that the sheet is detected downstream of the conveyance roller 121 like the present embodiment. That is, this arrangement makes it possible to more accurately control the conveyance speed such that variation of the time when the sheet actually arrives at the target position is reduced.

The feed sensor 120 of the present embodiment is a trough-beam type photoelectric sensor using a sensor flag. The through-beam type photoelectric sensor is excellent in terms of cost as compared to a photoelectric sensor, i.e., a so-called photo reflector that illuminates a detection light toward a sheet conveyance path and detects reflection light reflected from a sheet. As illustrated in FIG. 3A, the feed sensor 120 is composed of a sensor flag 123 and a photointerrupter 122. The sensor flag 123 is a flag member of the present embodiment, and the photointerrupter 122 is a detection unit of the present embodiment.

The sensor flag 123 includes a shaft 123*a*, a sheet contact portion 123*b* and a light-blocking portion 123*c*, and the sheet contact portion 123*b* and the light-blocking portion 123*c* pivot in a body centering on the shaft 123*a*, i.e., a pivot. The photointerrupter 122 includes a light-emitting component 122*a* that emits the detection light and a photosensing portion 122*b* that detects the detection light and is disposed such that an optical axis of the detection light intersects with a pivoting locus of the light-blocking portion 123*c*. As illustrated in FIG. 3B in which the sheet S is not in contact with the sheet contact portion 123*b*, the light-blocking portion 123*c* is located at a position, i.e., a standby position, where the light-blocking portion 123*c* does not block the optical axis of the photointerrupter 122. As the sheet S comes into contact with the sheet contact portion 123*b* and the sensor flag 123 pivots by a predetermined angle, i.e., until the detection position, as illustrated in FIG. 3C, the light-blocking portion 123*c* blocks the optical axis of the photointerrupter 122, and a detection signal of the photointerrupter 122 is changed.

Right Door

Figure 5:
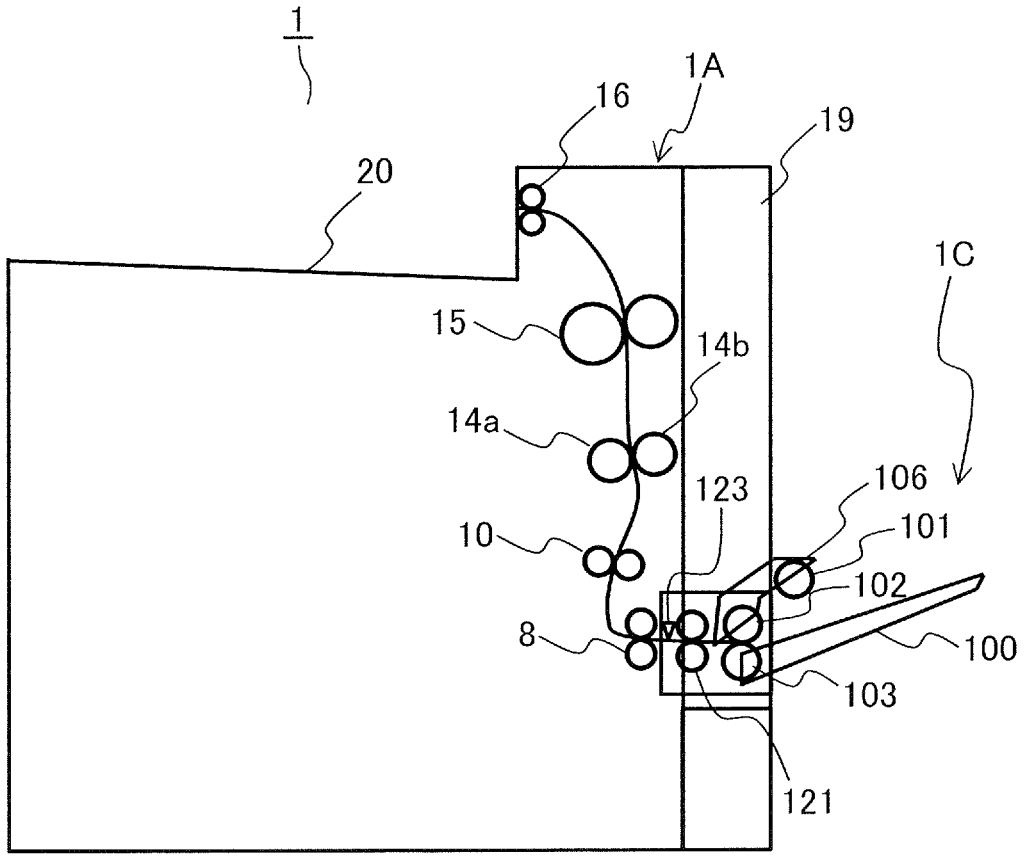
FIG. 5 is a schematic diagram illustrating a right door of the present embodiment.

Next, a relationship between the openable portion and the manual sheet feed portion 1C of the image forming apparatus 1 will be described. As illustrated in FIG. 5, the image forming apparatus 1 is provided with a right door 19 to be opened and closed with respect to the apparatus body 1A on a right side surface when seen from a front side of the apparatus. The right door 19 is the openable portion of the present embodiment, is an exterior of the image forming apparatus 1, and enables access to an inside of the apparatus in removing a jammed sheet jammed within the apparatus.

Here, in a configuration in which the manual sheet feed portion 1C and the right door 19 are disposed on a same side surface of the image forming apparatus 1, the manual sheet feed portion 1C may be attached as follows for example. One method is to fix the manual sheet feed portion 1C to the right door 19 and to move the manual sheet feed portion 1C along with an opening/closing operation of the right door 19 (referred to as "right door fixing type" hereinafter). Another method is to fix the manual sheet feed portion 1C to the apparatus body 1A (referred to as a "main body fixing type" hereinafter).

Among those attachment methods, because the position of the manual sheet feed portion 1C is fixed to a frame of the apparatus body 1A in the main body fixing type, the manual sheet feed portion 1C is less misaligned as compared to the right door fixing type. This point is advantageous in terms of reducing misalignment of the sheet fed from the manual sheet feed portion 1C by improving alignment between the conveyance rollers 121 provided in the manual sheet feed portion 1C and the conveyance roller 8 provided in the apparatus body 1A. That is, the main body fixing type is advantageous as compared to the other method in terms of contribution of improving quality of products by suppressing variation of an image position with respect to a sheet.

However, in the manual sheet feed portion 1C of the main body fixing type, the sensor flag 123 of the feed sensor 120 stays in the body side even in a state where the right door 19 is open. There has been a case where a sheet is torn by this configuration in removing a jammed sheet by opening the right door 19. The case where the sheet is torn will be described below as compared to a reference example of the right door fixing type.

Figure 6A:
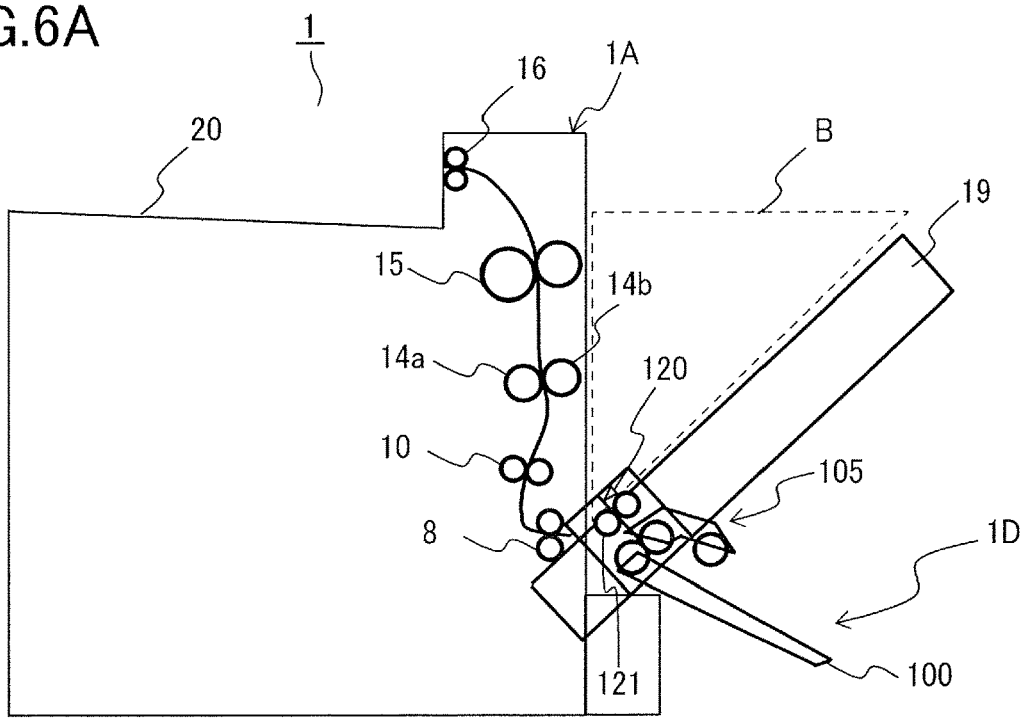
FIG. 6A is a schematic diagram illustrating a reference example that adopts a right door fixing type sheet feeding unit.

FIG. 6A illustrates an image forming apparatus 1 of the reference example including the right door fixing type manual sheet feed portion 1D. As the right door 19 is open, a work space B for handling a jammed sheet is created between the right door 19 and the apparatus body 1A. A user can remove the jammed sheet jammed in the sheet conveyance path of the manual sheet feed portion 1D and the apparatus body 1A by inserting his/her hand to the work space to pull out the sheet.

Figure 6B:
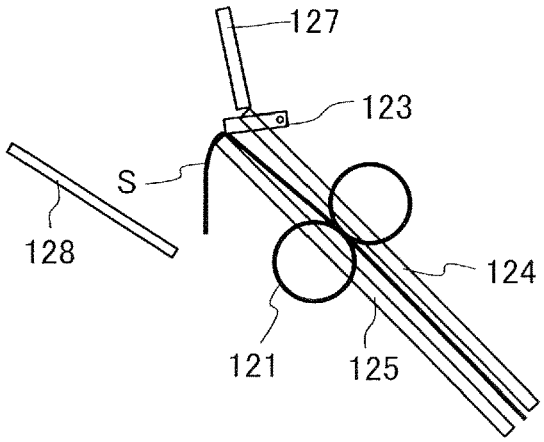
FIG. 6B is a schematic diagram illustrating a state in removing a jammed sheet in the reference example.
Figure 6C:
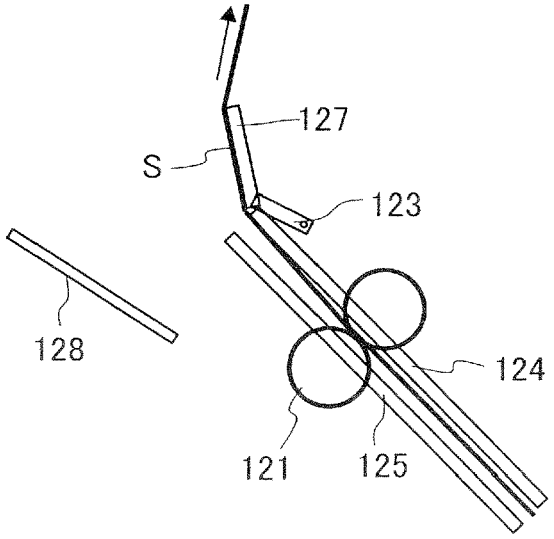
FIG. 6C is a schematic diagram illustrating another state in removing the jammed sheet in the reference example.

In the case of the right door fixing type, all of the conveyance roller 121, the upper conveyance guide 124, the lower conveyance guide 125, the upper pre-registration guide 127 and the feed sensor 120 are supported by the right door 19 as illustrated in FIG. 6B. In this case, while these members move along with the opening operation of the right door 19, the lower pre-registration guide 128 stays in the apparatus body 1A. In a case where there is a jammed sheet jammed while being nipped by the conveyance roller 121, it is possible for the user to remove the sheet by grasping and pulling out the sheet from the work space B in an upper right direction as illustrated in FIG. 6C. In that case, because the sensor flag 123 of the feed sensor 120 recedes by being pressed by the sheet, basically no such situation in which the sheet is caught by the sensor flag 123 and is torn occurs.

Figure 7A:
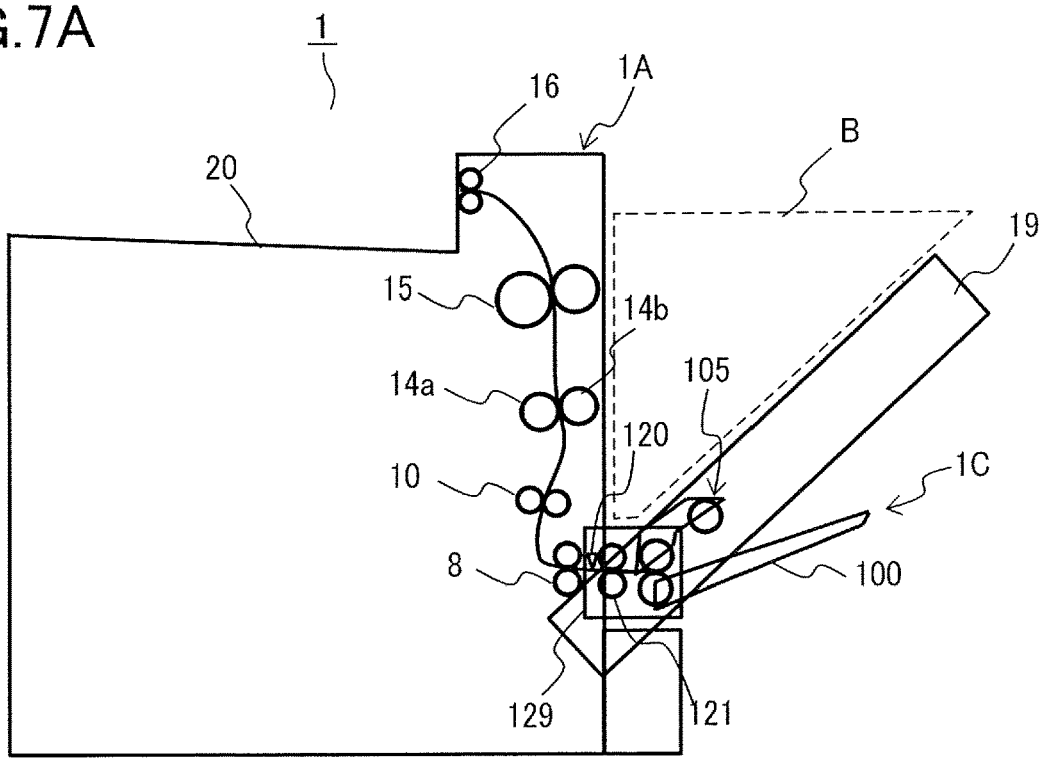
FIG. 7A is a schematic diagram illustrating the present embodiment which adopts a main body fixing type.

Meanwhile, the present embodiment adopts the main body fixing type manual sheet feed portion 1C as illustrated in FIG. 7A. In this configuration, a feed frame 129 composing a frame member of the manual sheet feed portion 1C is attached to a body frame 20 composing a frame member of the apparatus body 1A without through the right door 19, and the manual sheet feed portion 1C does not move even if the right door 19 is open.

Figure 7B:
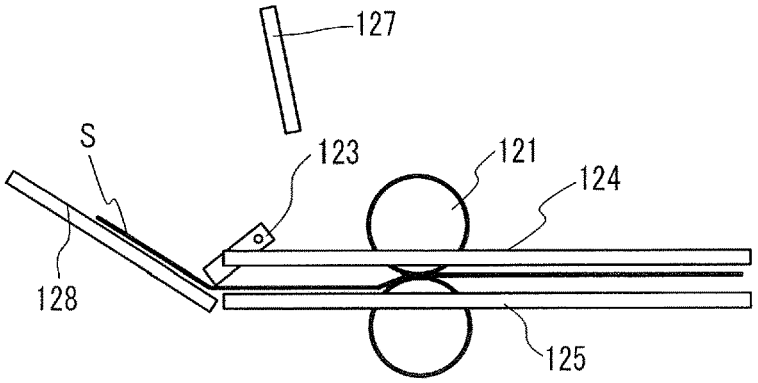
FIG. 7B is a schematic diagram illustrating a state in removing a jammed sheet in the present embodiment.
Figure 7C:
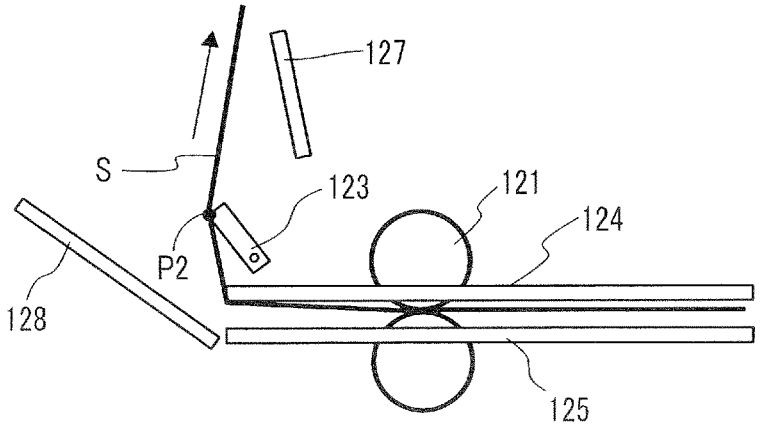
FIG. 7C is a schematic diagram illustrating another state in removing the jammed sheet in the present embodiment.

In a state where the right door 19 is open, the conveyance roller 121, the upper conveyance guide 124, the lower conveyance guide 125 and the feed sensor 120 stay at the same positions with those in a state where the right door 19 is closed as illustrated in FIG. 7B. Meanwhile, the upper pre-registration guide 127 is disposed on the right door 19 and separates from the lower pre-registration guide 128 along with the opening operation of the right door 19. Thereby, the sheet conveyance path is open toward the downstream side of the conveyance roller 121, so that the user can remove the jammed sheet by grasping and pulling out the sheet S by stretching his/her hand to the work space B as illustrated in FIG. 7C.

Here, because the sensor flag 123 of the feed sensor 120 is supported by the apparatus body 1A in the case of the main body fixing type, an axial position or a center position of a shaft 123*a* of the sensor flag 123 in the state where the right door 19 is open does not change from the state where the right door 19 is closed. Meanwhile, because the upper pre-registration guide 127 separates from the lower pre-registration guide 128 in the state where the right door 19 is open, a part of the sensor flag 123 is protruded toward the work space B between the upper pre-registration guide 127 and the lower pre-registration guide 128. Therefore, the sheet S comes into slidable contact with the upper conveyance guide 124 and the sensor flag 123 when the jammed sheet is to be removed. Still further, a pivotable range of the flag member is often limited by a stopper or the like. In this case, the sheet S is pulled out while being in contact with the flag member with a stronger force.

A width, i.e., a widthwise length in a width direction orthogonal to the sheet conveyance direction, of a tip of the sensor flag 123 is smaller than a width of the upper conveyance guide 124. Therefore, stress of the sheet S concentrates on a contact portion in contact with the tip of the sensor flag 123 when the sheet S slides while in contact with the sensor flag 123 when the jammed sheet is to be removed. As a result, there is a possibility that the sheet is torn from the contact portion with the sensor flag 123 in the configuration of the main body fixing type. A sheet having less strength such as a thin sheet is liable to be torn when the sheet is to be removed. If a new sheet S is to be fed in a condition in which a piece of the torn sheet remains within the apparatus, it leads to an occurrence of conveyance failure such as sheet jamming and of abnormal sound.

Jam Release Guide

In order to prevent the sheet from being torn, according to the present embodiment, a jam release guide is disposed in the manual sheet feed portion 1C. A configuration and an operation of the jam release guide will be described with reference to FIGS. 8 through 11.

Figure 8A:
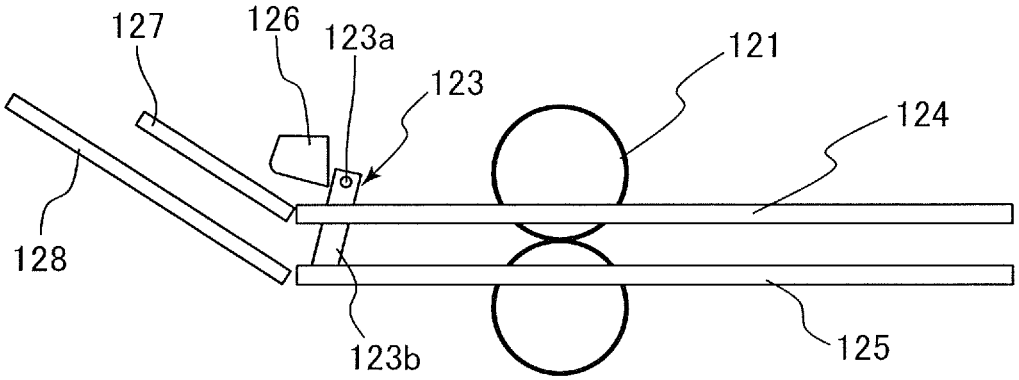
FIG. 8A illustrates a jam release guide of the present embodiment.
Figure 8B:
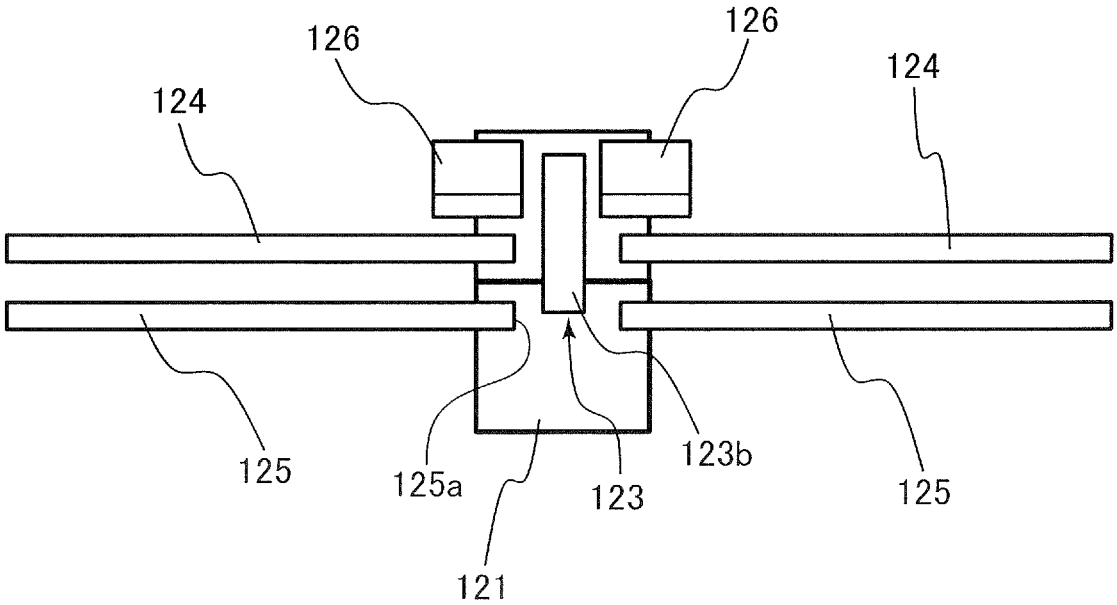
FIG. 8B illustrates the jam release guide of the present embodiment.

FIG. 8A is a schematic diagram illustrating a periphery of the feed sensor 120 in a state where the right door 19 is closed, and FIG. 8B is a schematic diagram when the periphery of the feed sensor 120 in FIG. 8A is seen from a left side. Note that the upper pre-registration guide 127 and the lower pre-registration guide 128 are not illustrated in FIG. 8B.

As illustrated in FIG. 8A, the jam release guide 126 of the present embodiment is positioned on a same side with the upper conveyance guide 124 and the upper pre-registration guide 127 with respect to the sheet conveyance path and in a vicinity of the sensor flag 123 of the feed sensor 120. The jam release guide 126 is fixed to the apparatus body 1A through the feed frame 129 of the manual sheet feed portion 1C (see FIG. 2A). The jam release guide 126 is located at a position overlapping widthwise with the sensor flag 123. Here, "two members overlap when seen in a predetermined direction" means that when each member is projected on an imaginary plane by using parallel rays in the predetermined direction, at least a part of a projection range of one member overlaps with a projection range of another member. Still further, as illustrated in FIG. 8B, the jam release guides 126 and 126 are provided widthwise on both sides of the sensor flag 123.

The sensor flag 123 is pivotable between three positions of a standby position, a detection position and a limit position. When the sensor flag 123 is located at the standby position as illustrated in FIGS. 8A and 8B, the sensor flag 123 is pivotable toward a downstream side in the sheet conveyance direction when pressed by the sheet. When no sheet passes through the sheet conveyance path, the sensor flag 123 is kept at the standby position by its own weight or by an urging force of a return spring member. In a state where the sensor flag 123 is located at the standby position, a sheet contact portion 123*b* of the sensor flag 123 has a length reaching to a guide surface on a far side from the shaft 123*a*, i.e., the lower conveyance guide 125, in the present embodiment. The lower conveyance guide 125 is provided with an opening portion 125*a* that accepts the sheet contact portion 123*b* of the sensor flag 123 located at the standby position.

The detection position is a position where a detection signal of the photointerrupter 122 (see FIG. 3A) is switched. That is, the detection position is a position of the sensor flag 123 at a moment when a light-blocking portion 123*c* blocks the optical axis of the photointerrupter 122 when the sensor flag 123 pivots, being pressed by the sheet, from the standby position.

The limit position is a position where the pivot of the sensor flag 123 is restricted when the sensor flag 123 pivots beyond the detection position from the standby position. That is, the limit position of the sensor flag 123 is a position where a pivot angle is maximized with respect to the standby position within the pivotable range of the sensor flag 123. In the present embodiment, the sensor flag 123 is restricted from pivoting beyond the limit position as the light-blocking portion 123*c* of the sensor flag 123 abuts with the upper conveyance guide 124.

However, the configuration of limiting the pivotable range of the sensor flag 123 is not specifically limited. For instance, it is possible to arrange such that a projection provided on the shaft 123*a* abuts against a stopper fixed to the frame of the manual sheet feed portion 1C. It is also possible to arrange such that a stopper portion integrally provided with the jam release guide 126 abuts against a part of the sensor flag 123 to limit the pivotable range. The limit position (angle) of the sensor flag 123 is large enough to enable the sheet contact portion 123*b* of the sensor flag 123 to recede to a position where the sheet contact portion 123*b* does not contact with the sheet passing through the sheet conveyance path in the state where the right door 19 is closed. Accordingly, an opening portion for accommodating the sheet contact portion 123*b* is provided in the upper pre-registration guide 127.

Figure 9A:
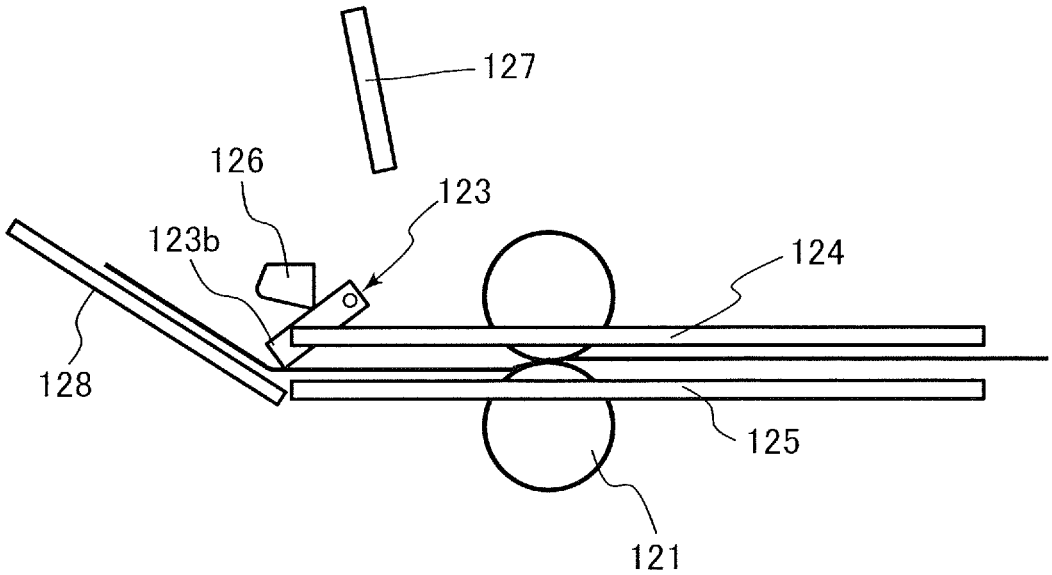
FIG. 9A illustrates an operation of the jam release guide of the present embodiment.
Figure 9B:
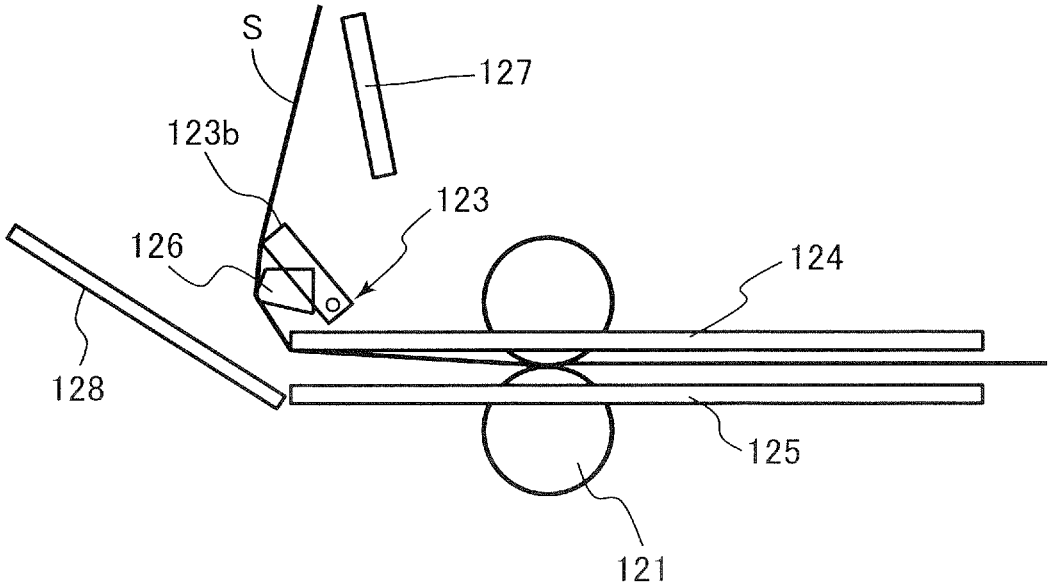
FIG. 9B illustrates the operation of the jam release guide of the present embodiment.

When the right door 19 is opened, the upper pre-registration guide 127 moves together with the right door 19 and separates from the lower pre-registration guide 128 as illustrated in FIG. 9A. The jam release guide 126 is disposed at a position where the jam release guide 126 can be in contact with the sheet S between the upper conveyance guide 124 and the sensor flag 123 that has pivoted to the limit position in the state where the right door 19 is open as illustrated in FIG. 9B.

The disposition of the jam release guide 126 is determined such that the following conditions are met:

Condition 1: At least a part of the jam release guide 126 is protruded into a hatched portion illustrated in FIG. 10A when seen in the width direction.

Condition 2: The jam release guide 126 is located at a position not in contact with the sheet or at least at a position where the jam release guide 126 does not hamper the conveyance of the sheet in the state where the right door 19 is closed.

Condition 3: The jam release guide 126 does not hamper the detection operation of the feed sensor 120 in the state where the right door 19 is closed.

Figure 10A:
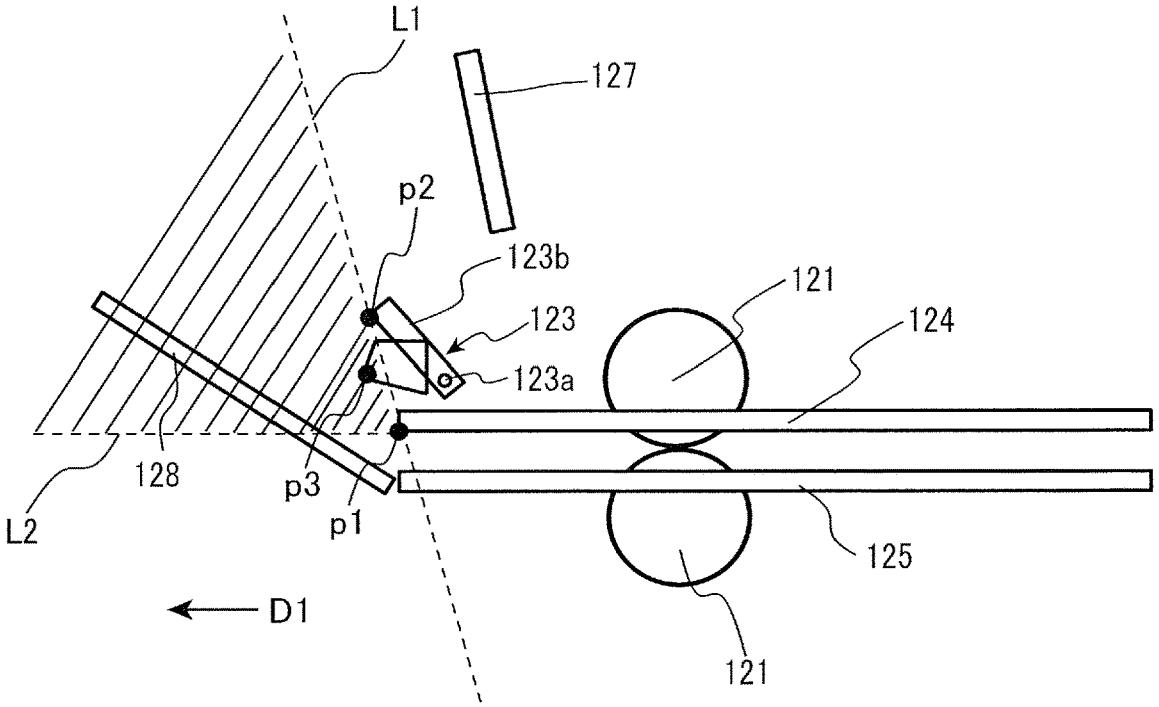
FIG. 10A illustrates a disposition of the jam release guide of the present embodiment.

Regarding the first condition, the hatched portion in FIG. 10A is a domain specified by a straight line L1 and a straight line L2. The straight line L1 is a straight line connecting the first contact portion p1 which is a downstream end position, i.e., a first point, in the sheet conveyance direction of the upper conveyance guide 124 and the second contact portion p2, which is a tip position, i.e., a second point, of the sheet contact portion 123*b* of the sensor flag 123 pivoting to the limit position. The straight line L2 is a straight line passing through the first contact portion p1 and is drawn along a moving direction D1 of the sheet passing through a position corresponding to the first contact portion p1. Note that the moving direction D1 is a tangential direction of a moving path P at a position closest to the first contact portion p1, wherein the moving path P of the sheet is an imaginary line connecting approximate center positions of the sheet conveyance path 130 in a thickness direction of the sheet as illustrated in FIG. 2B. The hatched portion is a domain extending downstream of the moving direction D1 of the sheet with respect to the first contact portion p1 and downstream in a direction heading from the first contact portion p1 to the second contact portion p2 among domains divided by the straight lines L1 and L2.

The first condition is what brings the sheet into contact with the jam release guide 126 in removing the jammed sheet in the state where the right door 19 is open. The jam release guide 126 of the present embodiment is disposed to protrude into the hatched portion in FIG. 10A toward the lower pre-registration guide 128 crossing over a line segment connecting the first contact portion p1 and the second contact portion p2 when seen in the width direction. Accordingly, the configuration of the present embodiment meets the first condition.

The second condition is met because the jam release guide 126 is kept away from the sheet conveyance path and is located at a position where the sheet passing through the sheet conveyance path does not come into contact with the jam release guide 126 in the state where the right door 19 is closed as illustrated in FIG. 8A. Note that the jam release guide 126 may be located at any position as long as the jam release guide 126 does not interfere the conveyance of the sheet in the state where the right door 19 is closed. For instance, the jam release guide 126 may be configured such that a part thereof is located on a same plane with a guide surface of the upper pre-registration guide 127 when seen in the width direction for example.

Figure 10B:
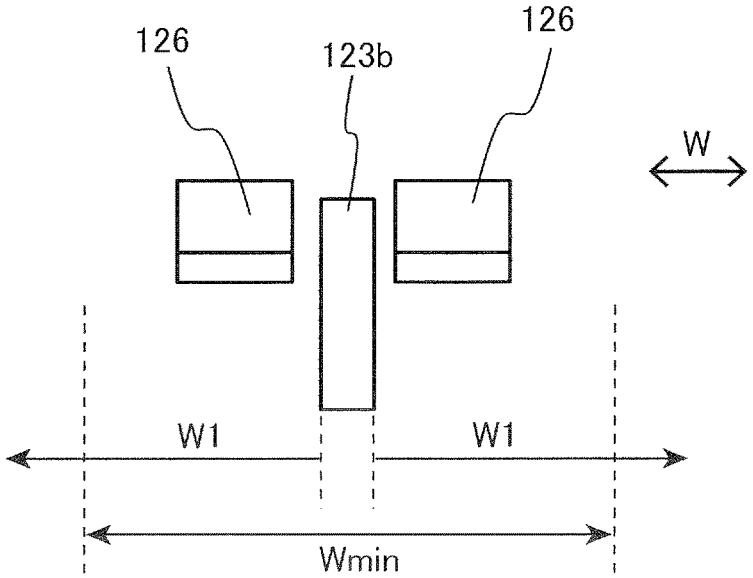
FIG. 10B illustrates the disposition of the jam release guide of the present embodiment.

Regarding the third condition, the jam release guide 126 may be disposed so as not to hamper the sensor flag 123 from pivoting between the standby position and the detection position in the state where the right door 19 is closed. That is, as illustrated in FIG. 10B, the jam release guide 126 may be disposed within a range W1 outside of the sheet contact portion 123*b* of the sensor flag 123. The third condition is met because the jam release guides 126 of the present embodiment are located on both sides of the sheet contact portion 123*b* of the sensor flag 123 in the width direction W and do not interfere with an entirety of the pivoting locus of the sheet contact portion 123*b*.

Figure 11A:
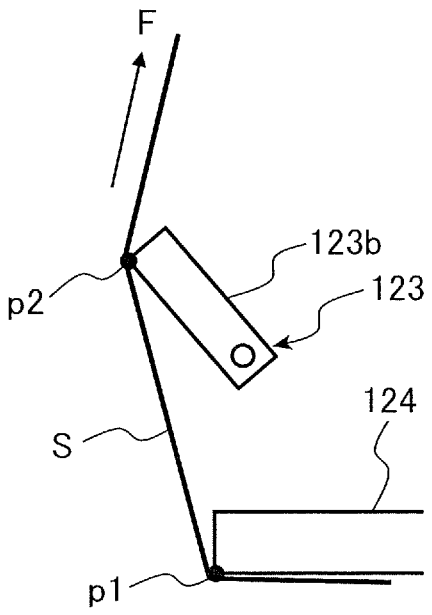
FIG. 11A illustrates a force acting on a jammed sheet in removing the jammed sheet in a case where the jam release guide is omitted.

An operation brought about by the jam release guide 126 will be described with reference to FIGS. 11A through 11D. FIG. 11A is a schematic diagram illustrating a state in which a jammed sheet is to be removed in a configuration in which the jam release guide 126 is omitted from the configuration of the present embodiment. Suppose that the user grasps the sheet S from the work space B and pulls up the sheet S by a force F in an upper right direction in FIG. 11A. The sheet S comes into contact with the upper conveyance guide 124 and the sensor flag 123 without looseness and bends at the first contact portion p1 and the second contact portion p2 when seen in the width direction.

Figure 11B:
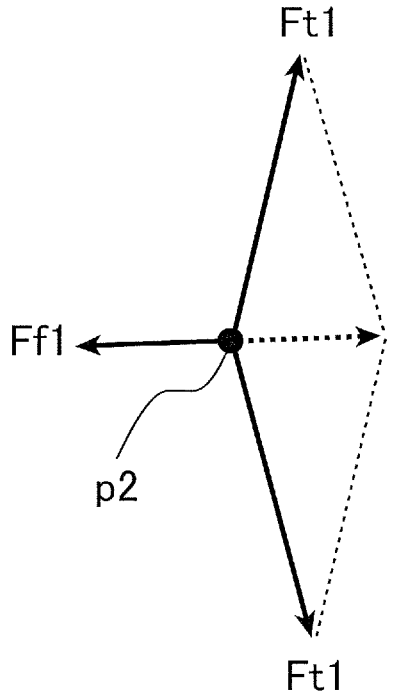
FIG. 11B illustrates forces acting on the jammed sheet in removing the jammed sheet in the case where the jam release guide is omitted.

In that situation, a tension Ft1 in the same direction with the force F, a tension Ft1 in a direction heading from the second contact portion p2 to the first contact portion p1 and a shearing force Ff1 act on the sheet S as illustrated in FIG. 11B. Magnitude of the tension Ft1 is almost equal to the force F by which the user pulls up the sheet S. The shearing force Ff1 corresponds to a reaction force by which the sensor flag 123 pressed by the sheet S pushes back the sheet S and magnitude thereof is equal to magnitude of resultant force indicated by an arrow of a broken line of the tensions Ft1 and Ft1. Therefore, the more sharply the sheet S bends at the part in contact with the second contact portion p2, the greater the shearing force Ff1 becomes.

Figure 11C:
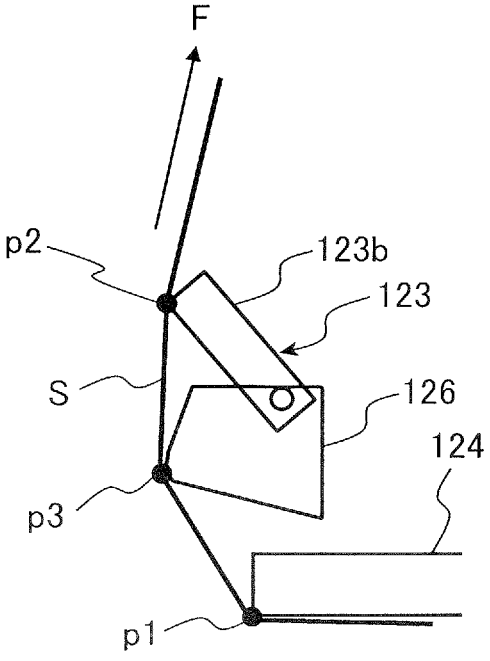
FIG. 11C illustrates a force acting on a jammed sheet in removing the jammed sheet in a case where the jam release guide is provided.

FIG. 11C is a schematic diagram illustrating a state in which a jammed sheet is to be removed in the configuration of the present embodiment including the jam release guide 126. Suppose that the user pulls the sheet S with the equal force F and in the same direction with those in FIG. 11A in FIG. 11C. In this case, the sheet S comes into contact with the jam release guide 126 between the first and second contact portions P1 and P2 when seen in the width direction. Therefore, the sheet S bends at a third contact portion p3 which is an edge portion of the jam release guide 126 between the first and second contact portions P1 and P2.

Figure 11D:
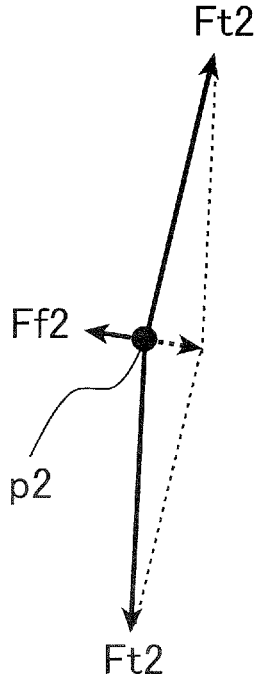
FIG. 11D illustrates forces acting on the jammed sheet in removing the jammed sheet in the case where the jam release guide is provided.

In that situation, a tension Ft2 in the same direction with the force F, a tension Ft2 in a direction heading from the second contact portion p2 to the third contact portion p3 and a shearing force Ff2 act on the sheet S at the second contact portion p2 as illustrated in FIG. 11D. As compared to the case illustrated in FIG. 11B, the direction of the tension Ft2, as indicated by a downward arrow in FIG. 11D on a side opposite from the force F, approaches to a direction just opposite from the force F. In other words, as compared to the case in FIG. 11A in which no jam release guide is provided, the jam release guide 126 regulates a posture of the sheet seen in the width direction so as to reduce a bending of the sheet at the second contact portion p2, i.e., to reduce an angle of the bend or to moderates the curve. Therefore, although the magnitude of the tension Ft2 is approximately equal to the force F and others as explained in the case illustrated in FIG. 11B, magnitude of a resultant force of the tensions Ft2 and Ft2 is reduced and magnitude of the shearing force Ff2 is reduced as well.

Thus, according to the present embodiment, concentration of stress applied to the sheet at the contact portion with the sensor flag 123 is reduced by disposing the jam release guide 126 so as to come into contact with the sheet between the first and second contact portions P1 and P2 in the state where the right door 19 is open. As a result, even in a case where the sheet S is pulled out while frictionally sliding with the sensor flag 123 that has pivoted to the limit position, it is possible to reduce the possibility that the sheet S is torn. Still further, because the jam release guide 126 is disposed to meet the second and third conditions, it is possible to reduce the possibility that the sheet S is torn in removing the jammed sheet without hampering the conveyance operation of the sheet and the detection operation of the feed sensor 120 in the state where the right door 19 is closed.

Note that it is preferable to dispose the jam release guides 126 only within a range Wmin through which a minimum width sheet, among sheets that can be fed by the manual sheet feed portion 1C, passes as illustrated in FIG. 10B. This arrangement makes it possible to prevent a widthwise edge of the sheet from being caught by the opening portion even in a case where the opening portion for avoiding interference with the jam release guide 126 in opening the right door 19 is provided in the upper pre-registration guide 127. However, a widthwise length of the jam release guide 126 is not basically limited and may be equal to a width of the upper conveyance guide 124.

The widthwise length of the jam release guide 126 or a total widthwise length of each guide in a case where the jam release guides 126 are provided on the both sides of the sensor flag 123 is preferable to be greater than a widthwise length of the sheet contact portion 123*b* of the sensor flag 123. It is because this arrangement reduces a contact pressure of the jam release guide 126 with the sheet and minimizes the possibility of causing breakage of the sheet starting from the contact portion with the jam release guide 126. It is also preferable to form the tip of the jam release guide 126 seen in the width direction into a curvature, e.g., an arc curve, smoothly connecting the straight line heading to the first contact portion p1 and the straight line toward the second contact portion p2.

Still further, because the jam release guide 126 and the upper conveyance guide 124 of the present embodiment are members located at positions close to each other and do not relatively move, they can be made as an integrated resin molded article. This arrangement of integrally molding the jam release guide 126 and the upper conveyance guide 124 makes it possible to reduce a number of parts and assembly man-hours, thus contributing to reduction of the cost.

In the structural example along the present embodiment, a protruding amount of the jam release guide 126 with respect to the straight line L1 connecting the first and second contact points p1 and p2, i.e., a distance between the third contact portion p3 and the straight line L1 in FIG. 10A, was preferable to be 1 mm or more and 10 mm or less. It was possible to obtain an effect of effectively reducing the shearing force Ff2 (see FIG. 11D) acting on the sheet by moderating the curve of the sheet at the second contact portion p2 by setting the protruding amount to be 1 mm or more. It was also possible to suppress the possibility of the breakage of the sheet starting from the contact portion with the jam release guide 126 by preventing the bend of the sheet at the third contact portion p3 from becoming excessively large by setting the protruding amount to be 10 mm or less. However, the abovementioned numerical range of the protruding amount is just one example, and the protruding amount may be changed as long the jam release guide 126 is disposed to come into contact with the sheet between the first and second contact portions P1 and P2 and thereby significantly reduces the breakage of the sheet.

Other Examples

While the sheet conveyance apparatus conveying the sheet fed from the manual sheet feed portion 1C of the image forming apparatus 1 has been described in the embodiment described above, this technology is also applicable to a sheet conveyance apparatus located at another part of the image forming apparatus. Still further, this technology is applicable not only to a sheet conveyance apparatus of an image forming apparatus including the image forming unit but also to a sheet conveyance apparatus conveying a sheet in a sheet processing apparatus or an image reading apparatus connected to the image forming apparatus. It is possible to realize the configuration of reducing breakage of a sheet in removing the jammed sheet by providing a guide having the characteristics described about the jam release guide 126 of the present embodiment also in those apparatuses.

Note that while the jam release guides 126 of the present embodiment are disposed on both widthwise sides of the sensor flag 123, it is possible to reduce the breakage of the sheet even if the jam release guide 126 is disposed only at either one side. Still further, the jam release guide may be disposed to be in contact with a sheet at a position different from that of the jam release guide 126 of the present embodiment as long as the jam release guide can regulate the posture of the sheet so as to reduce the bend at the contact portion with the flag member. For instance, the jam release guide may be arranged to come into contact with the sheet in a range including the first contact portion p1 or a range including the second contact portion p2.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-166089, filed on Sep. 5, 2018, which is hereby incorporated by reference herein in its entirety.

What is claimed is:

1. A sheet conveyance apparatus comprising:

a first guide provided in an apparatus body:

a second guide provided in an openable portion configured to be opened and closed with respect the apparatus body, the second guide being arranged to define a sheet conveyance path between the first guide and the second guide in a state where the openable portion is closed and to separate from the first guide along with an opening operation of the openable portion;

a flag member supported by the apparatus body pivotally on a pivot provided on a same side with the second guide with respect to the sheet conveyance path and configured to pivot when pressed by a sheet passing through the sheet conveyance path;

a detection unit configured to detect pivoting of the flag member; and a jam release guide provided in the apparatus body, wherein in a state where the openable portion is open, the flag member is protruded into a space that is created between the openable portion and the apparatus body by the opening operation of the openable portion, and wherein the jam release guide is disposed at a position not hampering conveyance of the sheet passing through the sheet conveyance path in a state where the openable portion is closed, and is disposed to come in contact, together with the flag member, with a jammed sheet jammed in the sheet conveyance path to regulate a posture of the jammed sheet in a state where the openable portion is open.

2. The sheet conveyance apparatus according to claim 1, further comprising an upstream guide provided in the apparatus body, the upstream guide being disposed adjacent to and upstream of the second guide in a sheet conveyance direction in the sheet conveyance path such that the upstream guide and the second guide face a same surface of the sheet passing through the second guide in a state where the openable portion is closed, wherein the jam release guide is configured to come in contact with the sheet at a position, in the sheet conveyance direction, between a position of a downstream end of the upstream guide and a position of a tip of the flag member in a state where the openable portion is open.

3. The sheet conveyance apparatus according to claim 2, wherein a first point is defined as a position of the downstream end in the sheet conveyance direction of the upstream guide when seen in a width direction orthogonal to the sheet conveyance direction, and a second point is defined as a position of the tip of the flag member pivoted to a limit position within a pivotable range of the flag member toward a downstream side in the sheet conveyance direction when seen in the width direction, wherein the second point is located downstream of the first point in a moving direction of the sheet in passing through a position corresponding to the first point of the sheet conveyance path, and the flag member is disposed such that the second point is protruded into the space that is created between the openable portion and the apparatus body by the opening operation of the openable portion, and wherein in a state where the openable portion is open, the jam release guide is protruded toward the first guide crossing over a line connecting the first and second points when seen in the width direction.

4. The sheet conveyance apparatus according to claim 1, further comprising:

a sheet supporting portion supported by the apparatus body and configured to support the sheet;

a sheet feeding unit configured to feed the sheet supported on the sheet supporting portion; and a sheet conveying unit configured to nip and convey the sheet fed by the sheet feeding unit, wherein the flag member is disposed downstream of the sheet conveying unit in a sheet conveyance direction in the sheet conveyance path.

5. The sheet conveyance apparatus according to claim 4, wherein the apparatus body comprises a body frame supporting the openable portion and a feed frame attached to the body frame, and wherein the sheet supporting portion, the sheet conveying unit, the flag member and the jam release guide are supported by the feed frame.

6. The sheet conveyance apparatus according to claim 4, wherein the sheet supporting portion is a manual feed tray configured to support the sheet to be fed by a manual feed operation.

7. The sheet conveyance apparatus according to claim 1, wherein the jam release guide is provided at a position overlapping with a pivoting locus of the flag member when seen in a width direction of the sheet in the sheet conveyance path, and is provided at least on one side of the flag member with respect to the width direction.

8. The sheet conveyance apparatus according to claim 7, wherein the flag member is provided on a center position of the sheet conveyance path in the width direction, and wherein the jam release guide is provided on both sides of the flag member in the width direction.

9. The sheet conveyance apparatus according to claim 1, wherein the second guide is provided with an opening portion to accommodate the jam release guide when opening the openable portion, and wherein the jam release guide is provided within a range, in a width direction of the sheet in the sheet conveyance path, where a sheet having a minimum widthwise length among sheets to be conveyed through the sheet conveyance path passes through and is not provided outside of the range.

10. The sheet conveyance apparatus according to claim 1, wherein the detection unit is a photointerrupter of which a detection signal changes depending on whether the flag member is blocking light, and wherein the flag member is restricted from pivoting beyond a predetermined angle greater than an angle by which the detection signal of the photointerrupter changes based on a position of the flag member in a case where the flag member is not pressed by the sheet.

11. An image forming apparatus comprising:

a sheet conveyance apparatus conveying a sheet;

an image forming unit forming an image on the sheet conveyed by the sheet conveyance apparatus, wherein the sheet conveyance apparatus comprises:

a first guide provided in an apparatus body:

a second guide provided in an openable portion configured to be opened and closed with respect the apparatus body, the second guide being arranged to define a sheet conveyance path between the first guide and the second guide in a state where the openable portion is closed and to separate from the first guide along with an opening operation of the openable portion;

a flag member supported by the apparatus body pivotally on a pivot provided on a same side with the second guide with respect to the sheet conveyance path and configured to pivot when pressed by a sheet passing through the sheet conveyance path;

a detection unit configured to detect pivoting of the flag member; and a jam release guide provided in the apparatus body, wherein in a state where the openable portion is open, the flag member is protruded into a space that is created between the openable portion and the apparatus body by the opening operation of the openable portion, and wherein the jam release guide is disposed at a position not hampering conveyance of the sheet passing through the sheet conveyance path in a state where the openable portion is closed, and is disposed to come in contact, together with the flag member, with a jammed sheet jammed in the sheet conveyance path to regulate a posture of the jammed sheet in a state where the openable portion is open.

12. A sheet conveyance apparatus comprising:

a first guide provided in an apparatus body:

a second guide provided in an openable portion configured to be opened and closed with respect the apparatus body, the second guide being arranged to define a sheet conveyance path between the first guide and the second guide in a state where the openable portion is closed and to separate from the first guide along with an opening operation of the openable portion;

an upstream guide provided in the apparatus body, the upstream guide being disposed adjacent to and upstream of the second guide in a sheet conveyance direction in the sheet conveyance path such that the upstream guide and the second guide face a same surface of the sheet passing through the second guide in a state where the openable portion is closed;

a flag member supported by the apparatus body pivotally on a pivot provided on a same side with the second guide with respect to the sheet conveyance path and configured to pivot when pressed by a sheet passing through the sheet conveyance path;

a detection unit configured to detect pivoting of the flag member; and a jam release guide provided in the apparatus body, wherein a first point is defined as a position of a downstream end in the sheet conveyance direction of the upstream guide when seen in a width direction orthogonal to the sheet conveyance direction, and a second point is defined as a position of a tip of the flag member pivoted to a limit position within a pivotable range of the flag member toward a downstream side in the sheet conveyance direction when seen in the width direction, wherein the second point is located downstream of the first point in a moving direction of the sheet in passing through a position corresponding to the first point of the sheet conveyance path, and the flag member is disposed such that the second point is protruded into a space that is created between the openable portion and the apparatus body by the opening operation of the openable portion, and wherein the jam release guide is disposed to be on a same side with the second guide and the upstream guide with respect to the sheet conveyance path and not to be protruded into the sheet conveyance path when seen in the width direction in a state where the openable portion is closed, and is disposed to be protruded toward the first guide crossing over a line connecting the first point and the second point when seen in the width direction in a state where the openable portion is open.

13. The sheet conveyance apparatus according to claim 12, further comprising:

a sheet supporting portion supported by the apparatus body and configured to support the sheet;

a sheet feeding unit configured to feed the sheet supported on the sheet supporting portion; and a sheet conveying unit configured to nip and convey the sheet fed by the sheet feeding unit, wherein the flag member is disposed downstream of the sheet conveying unit in a sheet conveyance direction in the sheet conveyance path.

14. The sheet conveyance apparatus according to claim 13, wherein the apparatus body comprises a body frame supporting the openable portion and a feed frame attached to the body frame, and wherein the sheet supporting portion, the sheet conveying unit, the flag member and the jam release guide are supported by the feed frame.

15. The sheet conveyance apparatus according to claim 13, wherein the sheet supporting portion is a manual feed tray configured to support the sheet to be fed by a manual feed operation.

16. The sheet conveyance apparatus according to claim 12, wherein the jam release guide is provided at a position overlapping with a pivoting locus of the flag member when seen in a width direction of the sheet in the sheet conveyance path, and is provided at least on one side of the flag member with respect to the width direction.

17. The sheet conveyance apparatus according to claim 16, wherein the flag member is provided on a center position of the sheet conveyance path in the width direction, and wherein the jam release guide is provided on both sides of the flag member in the width direction.

18. The sheet conveyance apparatus according to claim 12, wherein the second guide is provided with an opening portion to accommodate the jam release guide when opening the openable portion, and wherein the jam release guide is provided within a range, in a width direction of the sheet in the sheet conveyance path, where a sheet having a minimum widthwise length among sheets to be conveyed through the sheet conveyance path passes through and is not provided outside of the range.

19. The sheet conveyance apparatus according to claim 12, wherein the detection unit is a photointerrupter of which a detection signal changes depending on whether the flag member is blocking light, and wherein the flag member is restricted from pivoting beyond a predetermined angle greater than an angle by which the detection signal of the photointerrupter changes based on a position of the flag member in a case where the flag member is not pressed by the sheet.

* * * * *